US010619473B2

(12) United States Patent
Duan et al.

(10) Patent No.: US 10,619,473 B2
(45) Date of Patent: Apr. 14, 2020

(54) APPLICATION OF DEPTH DERIVATIVE OF DISTRIBUTED TEMPERATURE SURVEY (DTS) TO IDENTIFY FLUID FLOW ACTIVITIES IN OR NEAR A WELLBORE DURING THE PRODUCTION PROCESS

(71) Applicant: Halliburton Energy Services, Inc., Houston, TX (US)

(72) Inventors: Hongyan Duan, Houston, TX (US); Steve Tichenor, Houston, TX (US); Henry Killen, Houston, TX (US); Mikko Jaaskelainen, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 179 days.

(21) Appl. No.: 15/575,046

(22) PCT Filed: Jun. 15, 2015

(86) PCT No.: PCT/US2015/035861

§ 371 (c)(1),
(2) Date: Nov. 17, 2017

(87) PCT Pub. No.: WO2016/204723

PCT Pub. Date: Dec. 22, 2016

(65) Prior Publication Data

US 2018/0149015 A1 May 31, 2018

(51) Int. Cl.

| | |
|---|---|
| ***E21B 47/06*** | (2012.01) |
| ***E21B 47/04*** | (2012.01) |
| ***E21B 47/10*** | (2012.01) |

(52) U.S. Cl.

CPC ..... *E21B 47/065* (2013.01); *E21B 47/06* (2013.01); *E21B 47/102* (2013.01)

(58) Field of Classification Search

CPC ..... E21B 47/065; E21B 47/06; E21B 47/04
See application file for complete search history.

(56) References Cited

U.S. PATENT DOCUMENTS 5,163,321 A * 11/1992 Perales ..... E21B 17/206 374/136
6,807,324 B2 * 10/2004 Pruett ..... G01K 15/002 374/E11.015

(Continued)

FOREIGN PATENT DOCUMENTS

CA 2978549 A1 12/2016
CA 2980865 A1 12/2016

OTHER PUBLICATIONS

CA Application Serial No. 2,987,395, Office Action, dated Nov. 23, 2018, 6 pages.

(Continued)

*Primary Examiner* — Catherine Loikith
(74) *Attorney, Agent, or Firm* — Gilliam IP PLLC

(57) ABSTRACT

A method for using the depth derivative of distributed temperature sensing data to identify fluid levels, gas production intervals, water production intervals, and other fluid flow activities inside or near the well-bore during the production process. The method may include providing a fiber optic based distributed temperature sensing measurement system through a production region. Temperatures through the production region are gathered as a function of the depth in the subsurface well and as a function of the elapsed time. The gathered data is utilized to calculate the depth derivative of the temperature changes as a function of depth in the subsurface well and of the elapsed time. The depth derivative data for analysis of the fluid levels are displayed by operators to identify fluid levels, gas production intervals, water production intervals, and other fluid (Continued)

flow activities inside or near the wellbore during the production process.

12 Claims, 11 Drawing Sheets

(56) References Cited

U.S. PATENT DOCUMENTS

| | | | | |
|---|---|---|---|---|
| 2014/0075297 | A1 | 3/2014 | Gunturu | |
| 2015/0114628 | A1* | 4/2015 | Chen | G01V 9/005 166/250.01 |
| 2015/0120194 | A1 | 4/2015 | Chen | |
| 2018/0106777 | A1* | 4/2018 | Duan | G01N 33/383 |
| 2018/0112519 | A1* | 4/2018 | Duan | E21B 47/1005 |
| 2018/0119539 | A1* | 5/2018 | Duan | E21B 47/042 |

OTHER PUBLICATIONS

"International Application Serial No. PCT/US2015/035861, International Search Report dated Mar. 15, 2016".
"International Application Serial No. PCT/US2015/035861, Written Opinion dated Mar. 15, 2016".
CA Application Serial No. 2,987,395, Office Action, dated Jul. 11, 2019, 6 pages.

* cited by examiner

APPLICATION OF DEPTH DERIVATIVE OF DISTRIBUTED TEMPERATURE SURVEY (DTS) TO IDENTIFY FLUID FLOW ACTIVITIES IN OR NEAR A WELLBORE DURING THE PRODUCTION PROCESS

BACKGROUND

This disclosure relates generally to temperature sensing, and more particularly, to the use of new methodologies for interpreting distributed temperature sensing information.

Fiber optic Distributed Temperature Sensing (DTS) systems were developed in the 1980s to replace thermocouple and thermistor based temperature measurement systems. DTS technology is often based on Optical Time-Domain Reflectometry (OTDR) and utilizes techniques originally derived from telecommunications cable testing. Today DTS provides a cost-effective way of obtaining hundreds, or even thousands, of highly accurate, high-resolution temperature measurements, DTS systems today find widespread acceptance in industries such as oil and gas, electrical power, and process control.

DTS technology has been applied in numerous applications in oil and gas exploration, for example hydraulic fracturing, production, and cementing among others. The collected data demonstrates the temperature profiles as a function of depth and of time during a downhole sequence. The quality of the data is critical for interpreting various fluid movements.

The underlying principle involved in DTS-based measurements is the detection of spontaneous Raman back-scattering. A DTS system launches a primary laser pulse that gives rise to two back-scattered spectral components. A Stokes component that has a lower frequency and higher wavelength content than the launched laser pulse, and an anti-Stokes component that has a higher frequency and lower wavelength than the launched laser pulse. The anti-Stokes signal is usually an order of magnitude weaker than the Stokes signal (at room temperature) and it is temperature sensitive, whereas the Stokes signal is almost entirely temperature independent. Thus, the ratio of these two signals can be used to determine the temperature of the optical fiber at a particular point. The time of flight between the launch of the primary laser pulse and the detection of the back-scattered signal may be used to calculate the spatial location of the scattering event within the fiber.

DTS technology has been applied to production monitoring for identifying gas/oil entry depths along the wellbore. It is especially meaningful for open hole completion. Oil and gas is usually at geothermal temperatures. But it is changes temperature as it approaches the wellbore due to pressure drop. This effect is usually called 'Joule Thompson' effect. At steady state, wellbore stays at geothermal except those depths, where oil and gas enters. DTS is used to try to find those depths that have different temperature from others.

Two methods are widely applied in industry to investigate these phenomena. DTS single trace analysis and DTS time-depth 2D image analysis. The first one is usually operated by including a limited amount of DTS curves in Depth-Temperature plot to find those noticeable local minimum temperatures on each single trace. The second method is to investigate the DTS data in Time-Depth 2D plot. There is a need for better tools to address these phenomena.

DETAILED DESCRIPTION

Figure 1A:
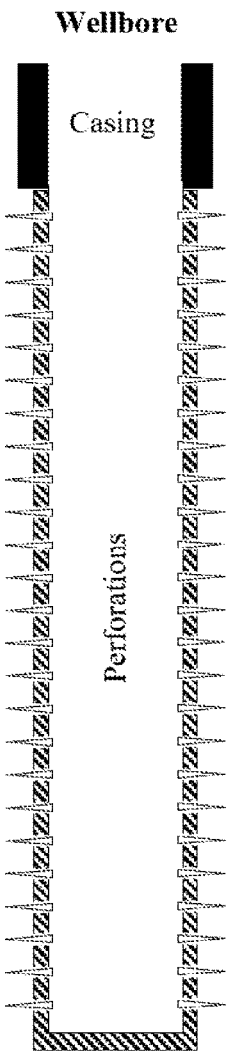
FIG. 1A illustrates a wellbore and FIG. 1B illustrates a corresponding DTS plot in the time and depth scale.

In the following detailed description, reference is made to accompanying drawings that illustrate embodiments of the present disclosure. These embodiments are described in sufficient detail to enable a person of ordinary skill in the art to practice the disclosure without undue experimentation. It should be understood, however, that the embodiments and examples described herein are given by way of illustration only, and not by way of limitation. Various substitutions, modifications, additions, and rearrangements may be made without departing from the spirit of the present disclosure. Therefore, the description that follows is not to be taken in a limited sense, and the scope of the present disclosure will be defined only by the final claims.

Two methods are widely applied in industry to review DTS data and to identify locations of thermal events, DTS single trace analysis and DTS time-depth 2D image analysis. The first one is usually operated by including and viewing a limited amount of DTS curves in a Depth-Temperature plot to find those noticeable local minimum temperatures on each single trace. The second method is to display the DTS data in Time-Depth 2D plot. Both of these methods are manual and qualitative, and highly depend on DTS data quality or noise level.

DTS technology has been applied to production monitoring for identifying gas/oil entry depths along the wellbore. It is especially meaningful for open hole completions. Fluids and gases in down-hole reservoirs are at geothermal temperatures. Fluids and gases may change temperature while migrating through the reservoir to the wellbore due to e.g. friction and pressure drop. The pressure drop induced temperature effect is called 'Joule Thompson' effect. At steady state production, the wellbore stays at geothermal temperature or slowly warms towards geothermal temperature after disturbances except at those depths where oil and gas enters and causes Joule-Thompson heating or cooling. DTS is used to find those locations that have different temperature behavior from other locations. The challenge with DTS trace analysis and time-depth DTS plots is that many of the temperature events that are indicative of flow events may be very small in magnitude, and difficult to find. A skilled data analyst would need to change the temperature scale numerous times while sifting through the data to identify the temperature events that would indicate flow events. And when data noise is high, the process becomes even more difficult since some of the temperature events are in same or lower level comparing with the noise variations. This is both time consuming and requires experience, and there is an obvious need for improved tools and methods to make DTS data interpretation more efficient and accurate.

A tool and a method will be shown where this need is met. Depth Derivative of DTS data is a tool that is able to detect subtle changes in DTS data, while reducing the manual input required by an expert. The tool and method can reduce large amounts of DTS traces into a matrix of data, i.e. a derivative plot, where automatic post processing may save a significant amount of time on color adjusting and highly reduce the error. Since the tool and method is irrelevant to the absolute value of temperature, one matrix of data can be used to produce a set of plots with different sensitivities. The minimum and maximum for a derivative plot, usually between −0.3 degree F./ft. to +0.3 degree F./ft. can be used for most of the production cases regardless of formation properties or the measured depth of the wells. Multiple plots can also be automatically generated as desired with different minimum and maximum gradient values as desired to allow the data analyst to select the optimum scale with minimum manual input. The method can capture a small change of the temperature despite its absolute value. And only the change that is persistent during a period of time can form a clear streak on the image, e.g. Joule-Thompson induced cooling of the formation at a fluid flow location. Therefore, the thermal events are able to stand out from random noises induced by system even though they are in same magnitude.

Another important fluid activity inside the bore hole is fluid level, which is often monitored and controlled to optimize production. Calculating the derivative of the DTS data offers an alternative tool besides pressure gauge data to monitor accurate location of the fluid level in the annulus of a well. DTS data plotted in time series and/or 2D plots may not be able to identify this.

DTS derivative can also identify the accurate time boundaries of other fluid activities inside or near the wellbore, such as well shut-in and production restart as well as cross-flow between different producing zones.

It should be noted before proceeding to an analysis of the figures in this disclosure that a preferred method of presentation in a hydraulic fracturing analysis to be shown is the use of color displays. Because color is not allowed in most patent applications the figures contained herein will be presented in a pure black and white. It will be seen however that the value of this approach will be evident even in black and white.

Figure 1B:
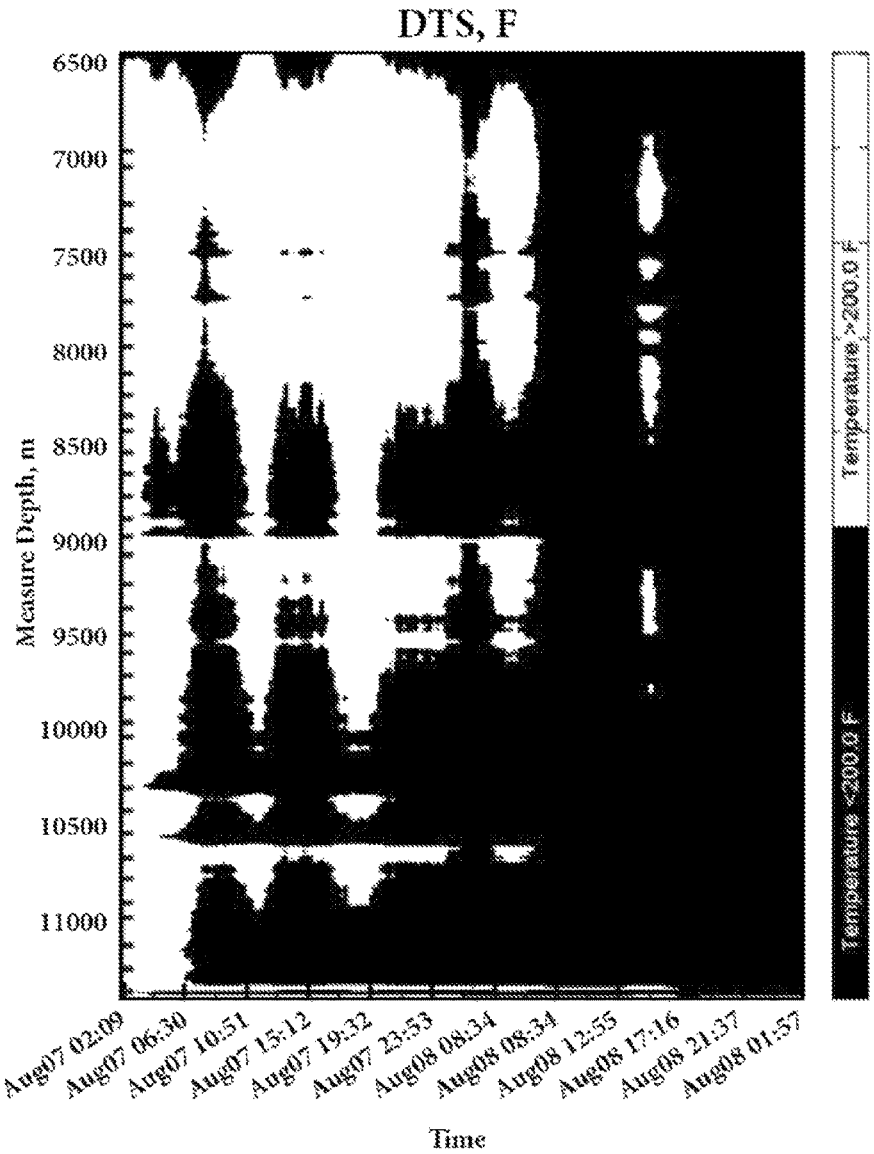
Figure 2:
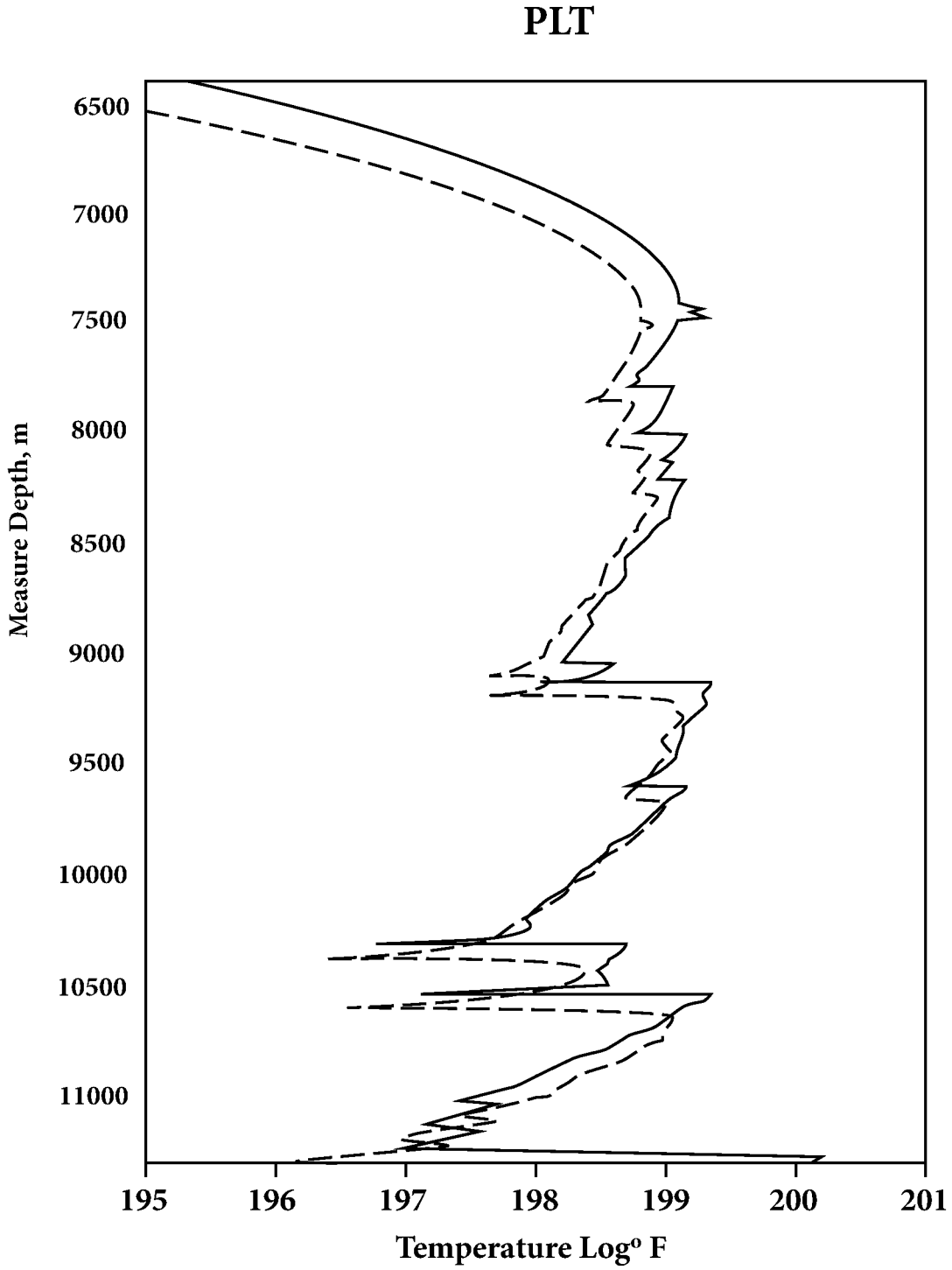
FIG. 2 illustrates PLT (Production Logging Tool) data of the same example as FIGS. 1A and 1B.
Figure 3:
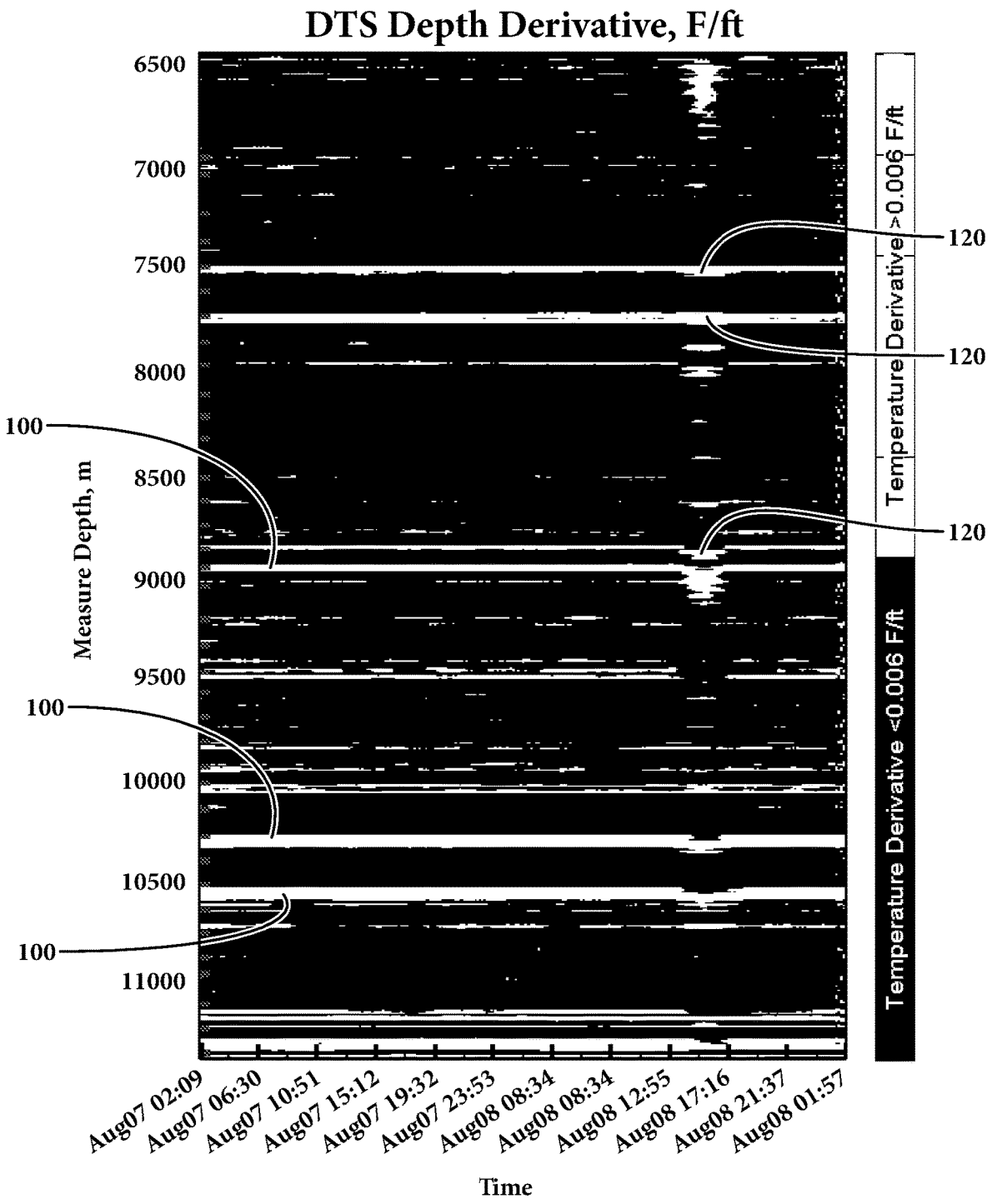
FIG. 3 illustrates a depth derivative of DTS plot in depth and time scale of the same data as FIG. 1B.
Figure 4A:
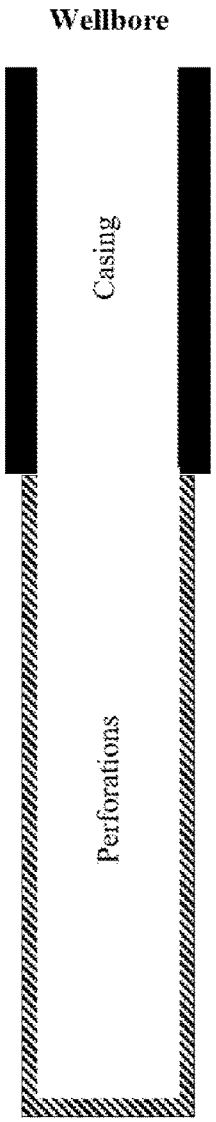
FIG. 4A illustrates a wellbore and FIG. 4B illustrates a corresponding DTS plot in the time and depth scale.
Figure 4B:
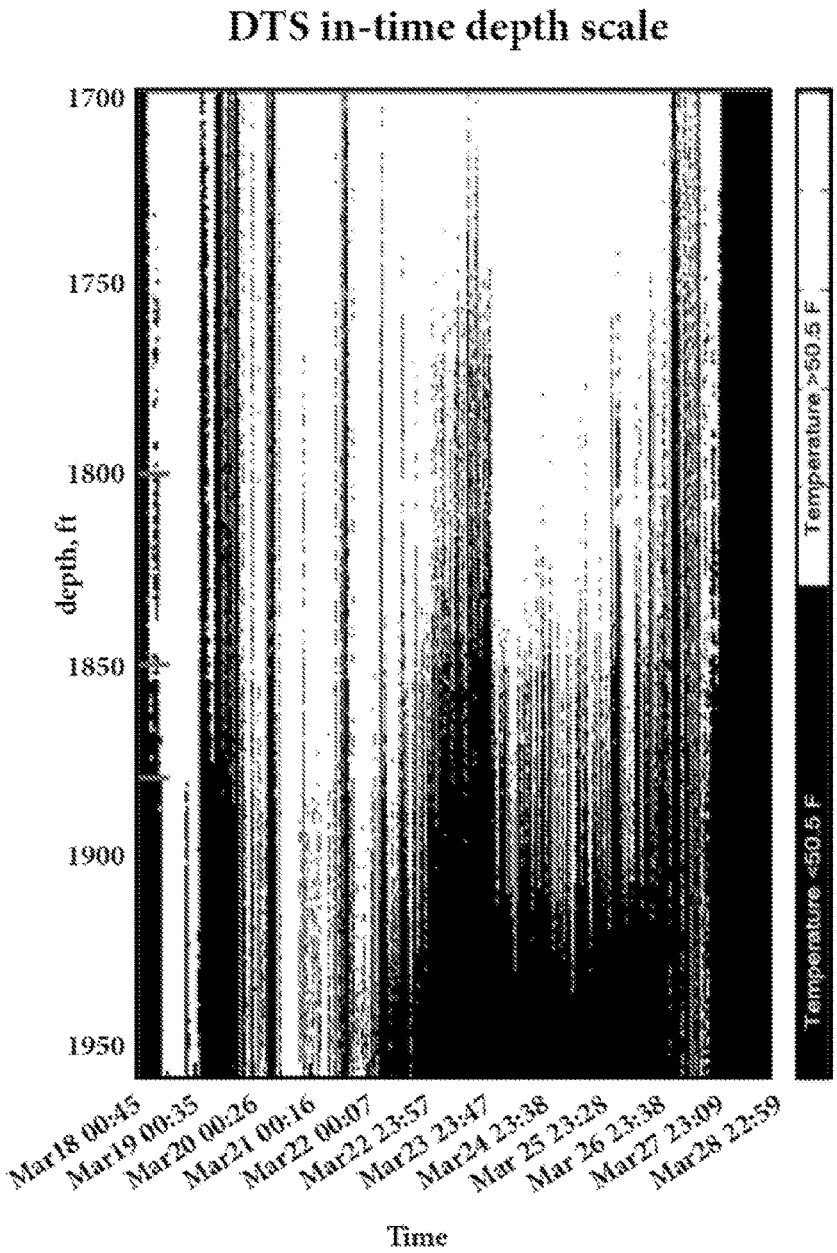
Figure 5:
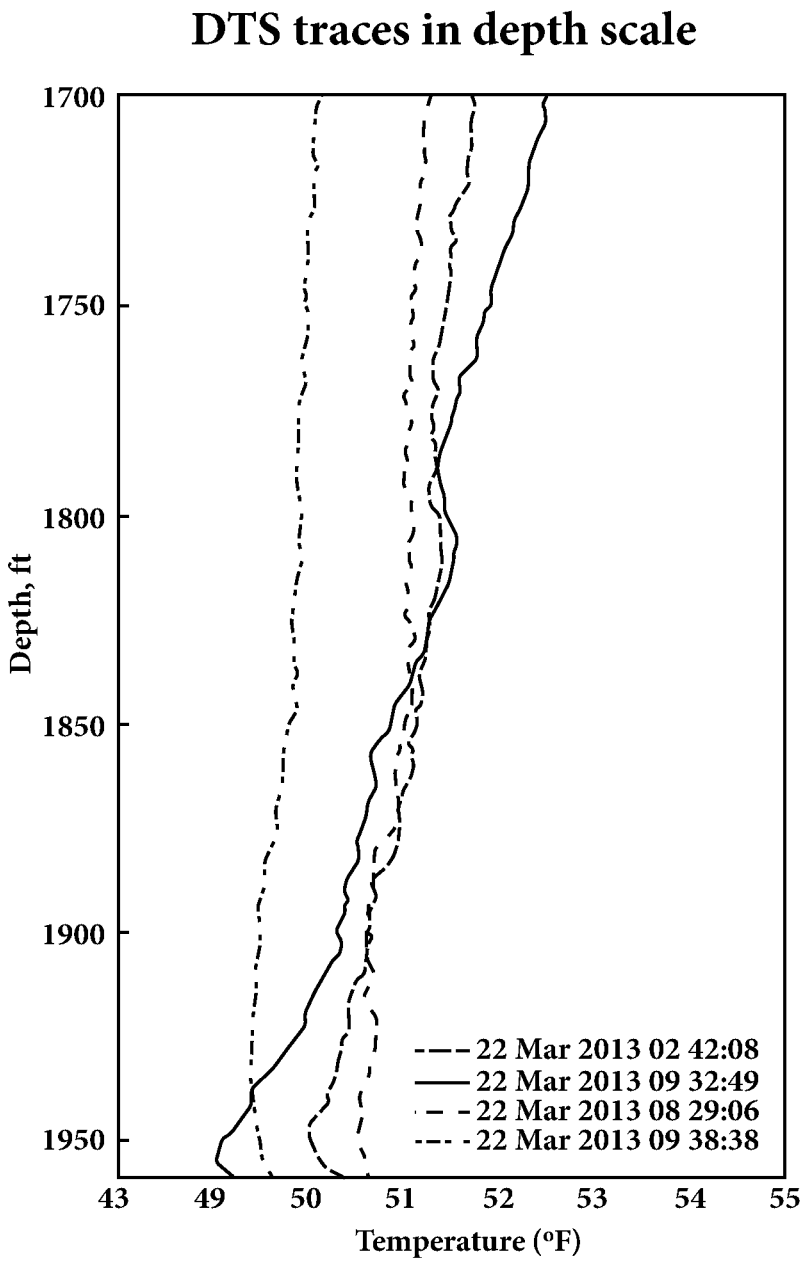
FIG. 5 illustrates four DTS traces from the same data as that of FIG. 4B.
Figure 6:
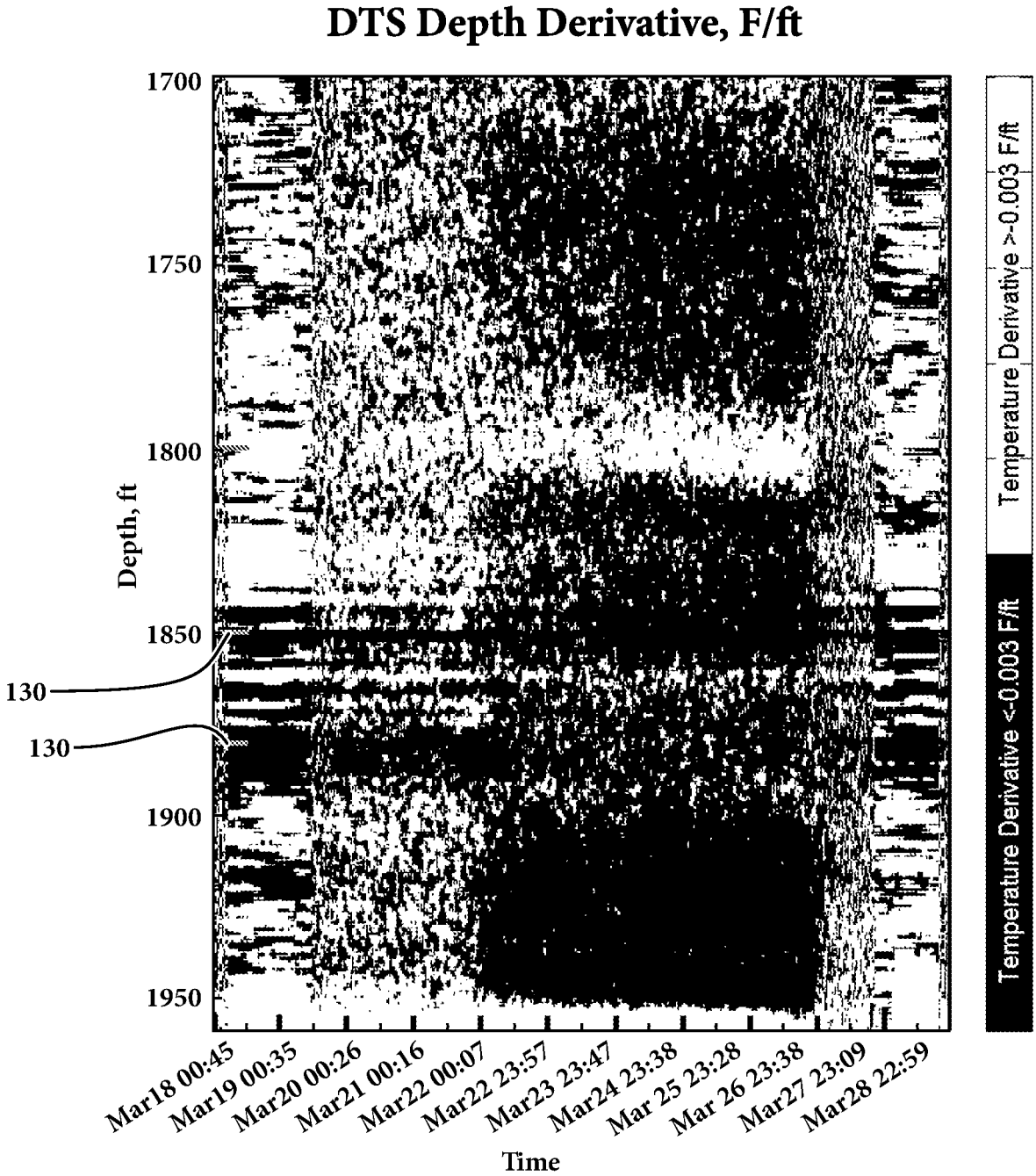
FIG. 6 illustrates a depth derivative of DTS plot in depth and time scale of the same data as FIG. 4B.

FIGS. 1, 2, and 3 are alternate views of a gas production process. All are showing the same data. FIG. 1B is a plot of conventional DTS data to compare the derivative method with PLT (FIG. 2) and DTS depth derivative data (FIG. 3) in a gas production process. In the derivative plot (FIG. 3), distinctive streaks 100 are found in several depths, which indicate the location of Joule-Thompson induced thermal events where the gas entering the well-bore. These streaks could appear in warm colors (red or yellow) in a color display, or colors as designated by the analyst. Persistent streaks indicate thermal events due to fluid and/or gas movement, and it is clear that the derivative plot highlight features over a larger time span and these features cannot be seen in the DTS plot (FIG. 1B) or the PLT traces (FIG. 2) with such clarity.

An examination of the PLT (Production Logging Tool) plot (FIG. 2) and the conventional DTS data (FIG. 1B) indicates that locations of thermal events could be selected by an experienced analyst after some substantial amount of work, but the accuracy and location of the selected events may not be as high as desired.

The PLT plot in FIG. 2 show two curves, one for a pass where the production logging tool is lowered into the well, and one for when the production logging tool is retrieved from the well. The weight on the cable will be different due to gravity and production flow in the well, and the cable will elongate causing uncertainty in the depth measurement. Well deviation, tool weight and friction may further impact the depth accuracy. The production logging tool is often located at the end of a slick-line or a wire-line, and the size of the tool is such that it will create a flow restriction in the well as the well is being logged, and this flow restriction may impact the temperature measurement accuracy.

The DTS plot in FIG. 1B show thermal changes over time, but requires a skilled analysts and a lot of work to differentiate between general warm-back of the well bore and subtle thermal changes due to small flow events. DTS data interpretation is labor intensive and is viewed as an art where a skilled data analyst sifts through data to detect thermal events.

The DTS depth derivative plot in FIG. 3 show clear horizontal streaks over time accurately indicating the location of persistent thermal events over time, and these events can then be used to model flow in a well. The DTS depth derivative plot can be generated from the DTS data in an automated fashion where the event magnitude has been identified during the development of the tool and method, and additional processing of the data can be done to further enhance the ability to identify the location of thermal events. Additional processing may include low-pass and/or high-pass filtering to remove frequency content in the data where the frequency content may indicate physically impossible events in the formation and well-bore.

Besides the fluid level and production interval, the depth derivative of DTS also shows certain other clear boundaries. As an example in FIG. 3 there is a short shut-in period 120 that exhibits clearly, and it is possible to see time varying thermal events at locations different from the consistent horizontal streaks that can be seen during normal production. Some of these are noticeable in the DTS plot (FIG. 1B), but are much more difficult to see, and the location and identification of these thermal events require a significant amount of work if they can be detected and/or identified at all. This phenomenon is highly unlikely to be identified from the PLT plot of FIG. 2 given that the production logging tool must be located in the well and moved across the appropriate depth interval at the appropriate time without disturbing the flow in the well.

A second example in FIGS. 4A 4B, 5, and 6 is of oil/water production. In examining FIGS. 5 (DTS trace) and 4B (DTS in the time depth scale), no obvious production interval can be identified from DTS data itself, either from single traces or from time-depth 2D plot because the rate of production is low. By contrast the derivative method, shown in FIG. 6 clearly exhibits horizontal streaks around the two depths 130 at 1850 ft and 1875 ft, where reservoir fluid is produced. This clearly shows the advantage of the tool and method where small persistent thermal events can be detected to improve data analysis and interpretation.

Figure 7A:
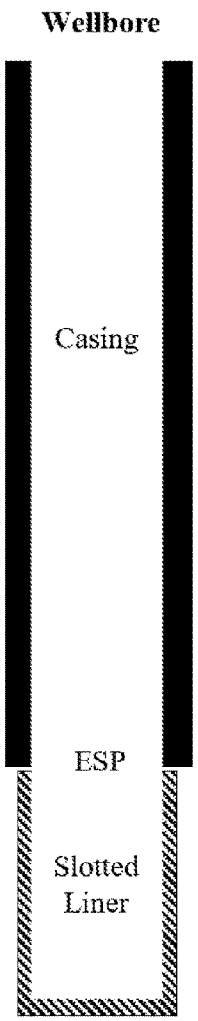
FIG. 7A illustrates a wellbore and FIG. 7B illustrates a corresponding DTS plot in depth and time scale.
Figure 7B:
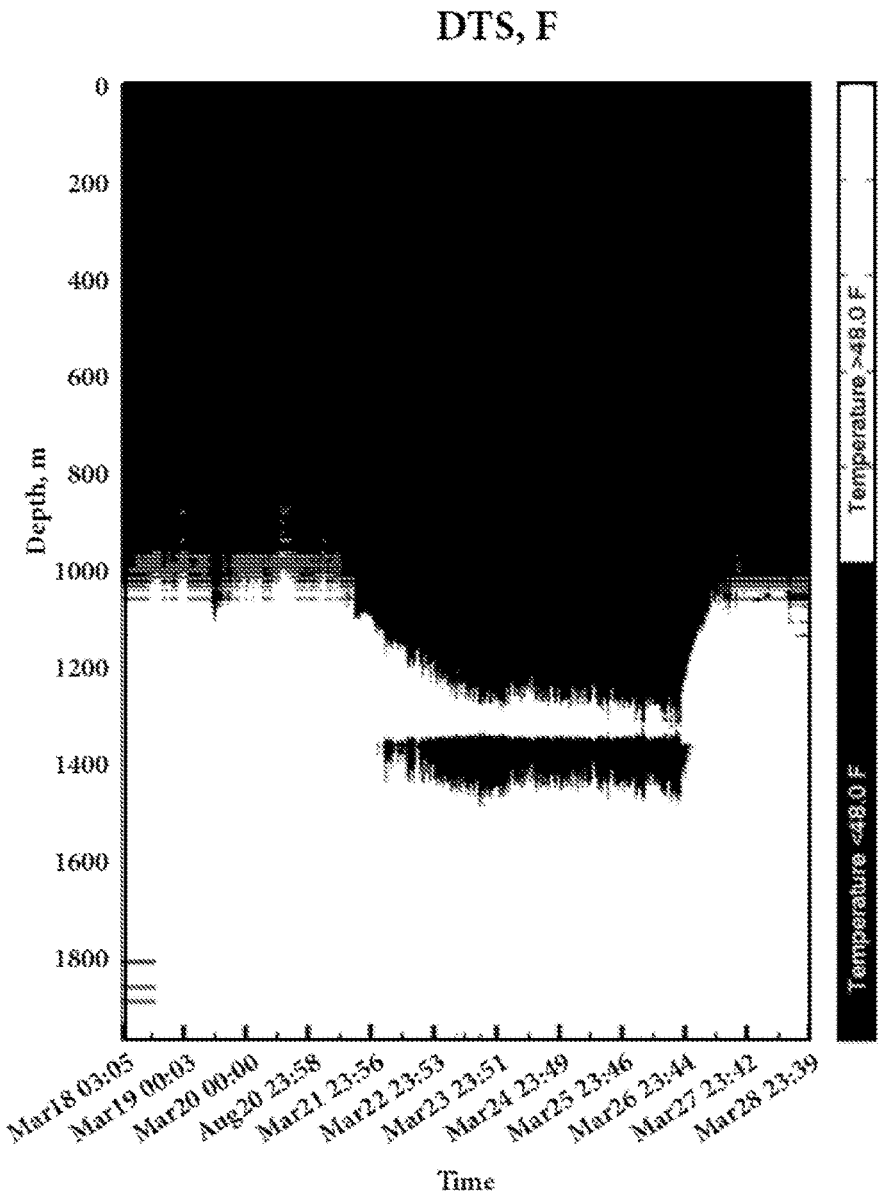
Figure 8:
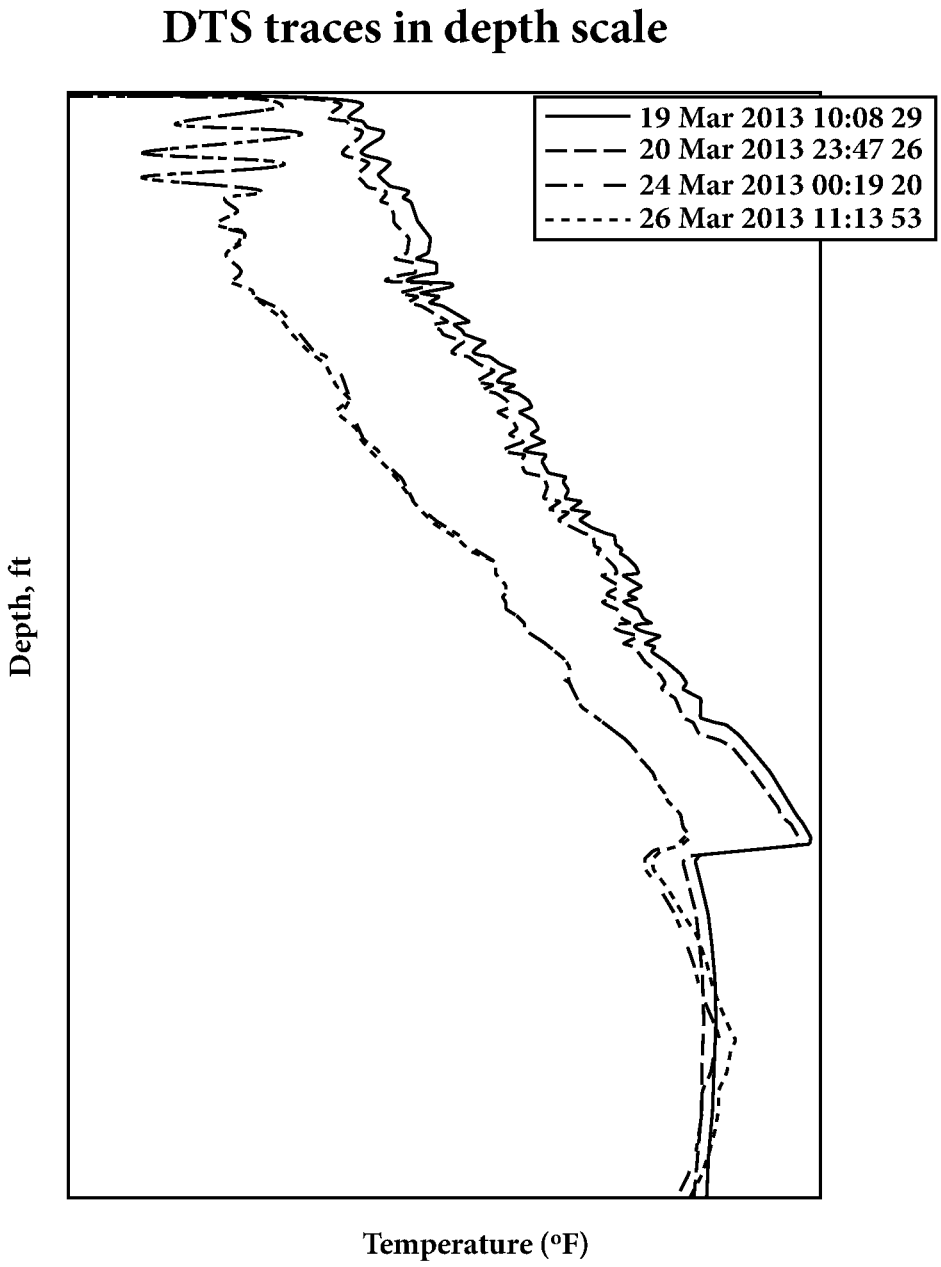
FIG. 8 illustrates a DTS trace in the depth scale of the same data as FIG. 7B.
Figure 9:
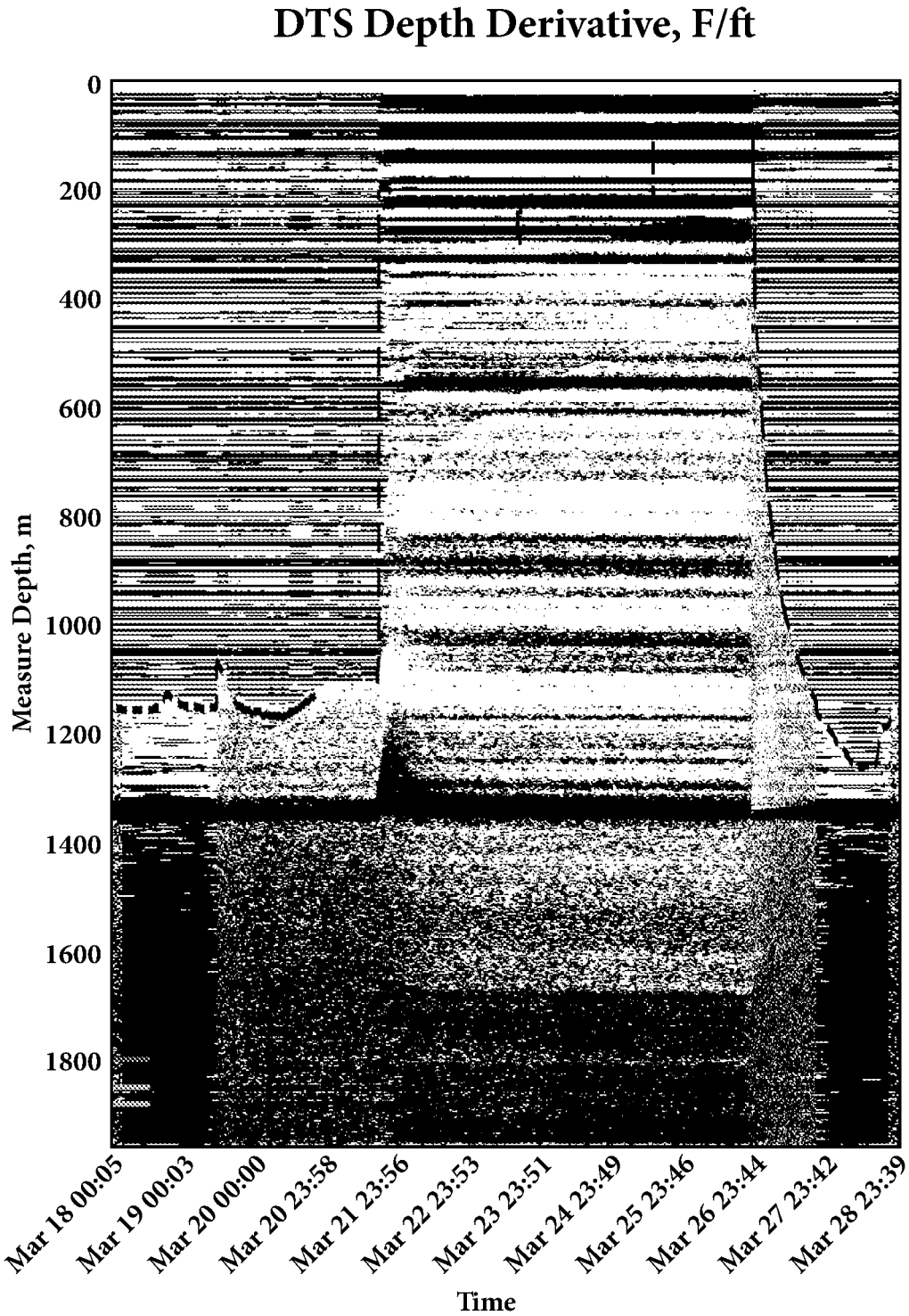
FIG. 9 illustrates a depth derivative of DTS trace in the depth and time scale of the example of FIG. 7B. Fluid level is also identified by a data variance algorithm and plotted as a dashed line in the Figure.

The third example presents another important fluid activity, detection and location of the fluid level in the annulus of a well. The data is presented in FIGS. 7A, 7B, 8, and 9. Air above the fluid level leads to an unstable temperature measurement of the DTS data comparing with the depths bellow the fluid level, but this is too subtle to be captured when only the absolute temperature value is plotted such as in FIG. 7B (DTS in time-depth scale) or FIG. 8 (DTS trace). But the depth derivative of the DTS plot in FIG. 9 is able to amplify this instability into a negative-positive domain and presents it as a multiple streaks in the map.

The fiber optic sensing cable may also have other fibers the may be used for other sensing systems like for example Distributed Acoustic Sensing (DAS) systems. Acoustic energy will travel at different velocities in liquids and air, and can be a complementary system to enable automation of a fluid boundary monitoring system. Acoustic energy will also attenuate differently in liquids and air, so changes in acoustic velocities and/or amplitude changes in various frequency bands may be used for fluid level detection. This DAS data can then be used in conjunction with the depth derivative data to better identify and validate the analysis of identify fluid levels, gas production intervals, water production intervals, and other fluid flow activities inside or near the wellbore during the production process.

Generation of Derivative DTS Data

The disclosure herein anticipates any mathematically correct manner of generating the derivative data. The example embodiment for calculating the depth derivative is explained as follows.

Derivative data from DTS data can be generated by feeding the numerical data of temperature as a function of depth and time into a matrix and then computationally moving through all of the matrix data points to calculate derivative values for each matrix element. This can be done as either depth derivatives or as time derivatives. These derivative values can then be presented as a matrix of numbers, or, more usefully can be presented as color images in which the various colors represent different values of the derivatives. As discussed earlier, they are presented herein as gray scale images which show important features that are not evident in the presentation of the conventional DTS data alone.

Depth Derivative of DTS:

In this example the computation language MatLab is used to compute regular DTS data into depth derivative of DTS. And the result can then be plotted by MatLab in depth-time scale.

For DTS measurement, Temperature is function of depth and time:

$$T=T(\text{depth},\text{time}) \quad (1)$$

Data is loaded into MatLab and stored as a DTS temperature matrix. See the first matrix in FIG. 3.

The depth derivative of DTS, also called the DTS depth gradient, is then computed as:

$$T'(d,t)=(T(d+\Delta d,t)-T(d+\Delta d,t))/(2*\Delta d) \quad (2)$$

The depth derivative at any depth and time step is calculated by subtracting the temperature at its previous depth from the one at its next depth and the result is divided by the distance between these two depths. This results in a depth derivative of the DTS temperature matrix, shown as the second matrix in FIG. 3, wherein each point is a derivative data point to be displayed.

Both the DTS temperature matrix and DTS derivative matrix can be plotted as a depth-time 2D color map by MatLab function pcolor(d,t,T) or pcolor(d,t,T'). Input parameters d and t are depth and time vectors. Input T is a 2D matrix with number of rows as d and number of columns as t.

Figure 10:
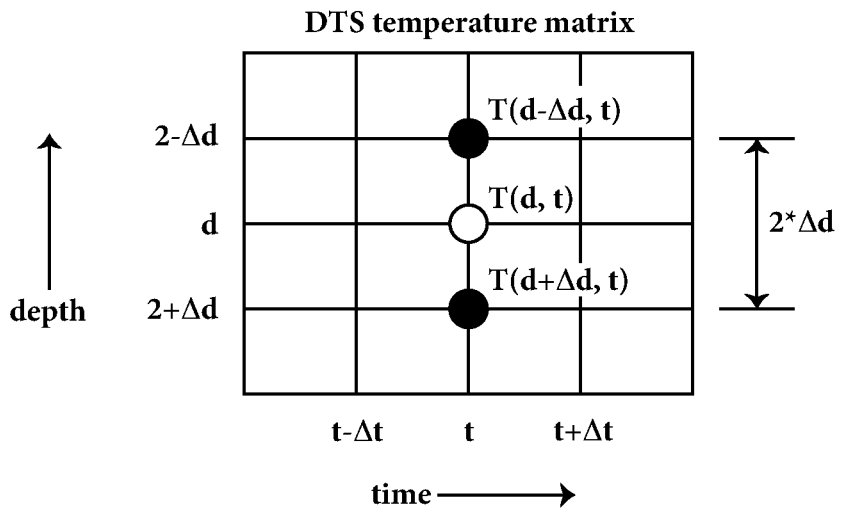
FIG. 10 illustrates the data matrices representing the DTS data for representing the depth derivative display.
Figure 10:
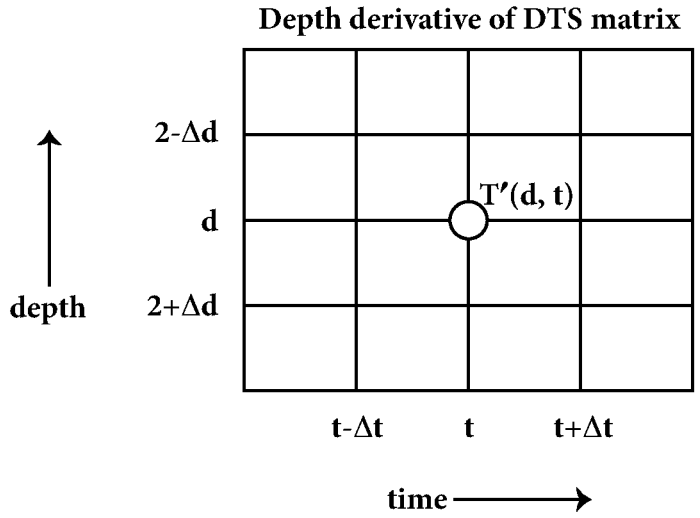
Figure 11:
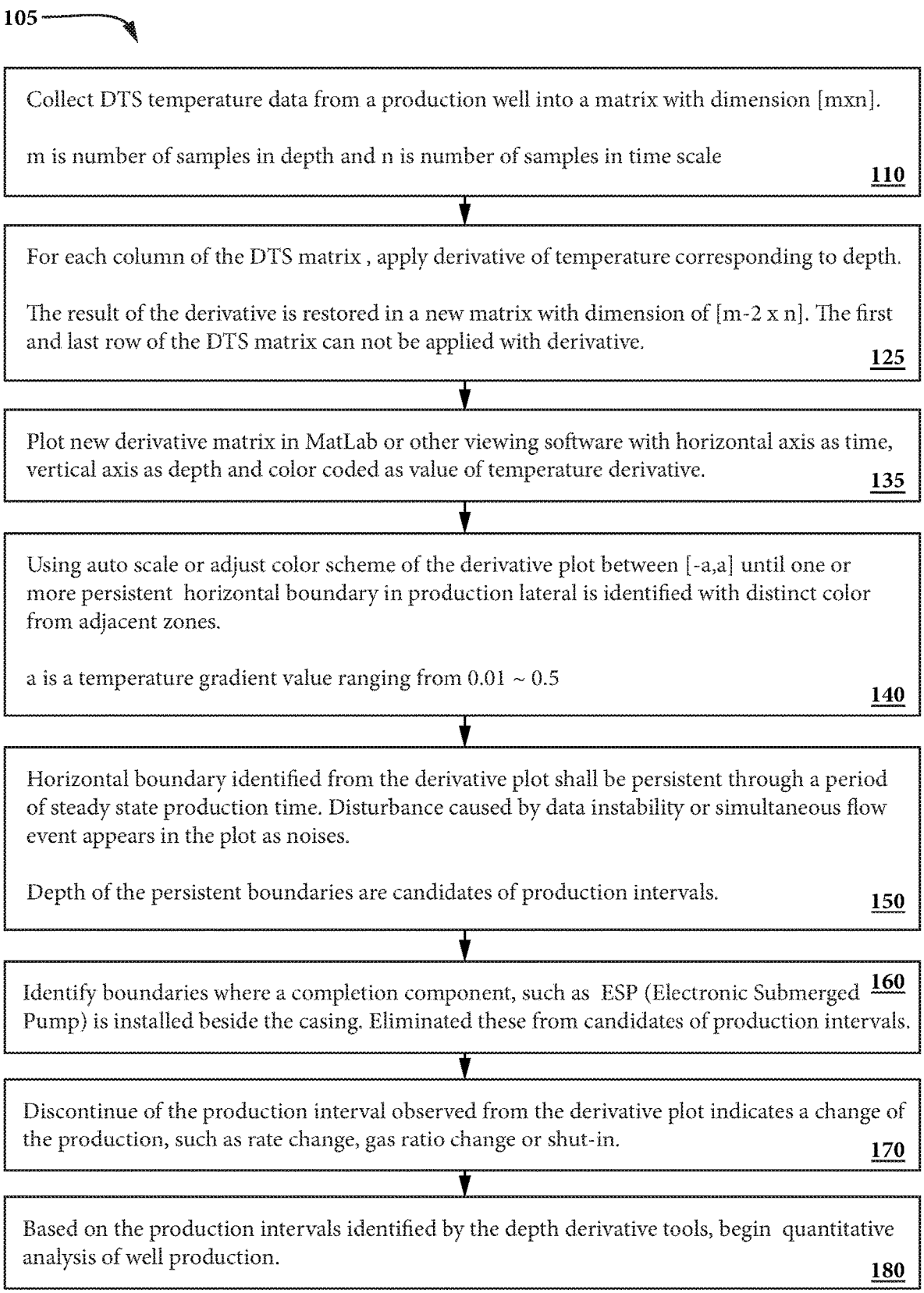
FIG. 11 illustrates a work flow for generating the data analysis for the identification.

The method can be described alternately with the process 105 as in FIG. 11. In the first step 110 a DTS system is used to collect temperature data from a production well into a matrix of dimensions [m×n], where m is the number of samples taken in the depth scale and n is the number of samples taken in time scale. In the step 125 for each column of the DTS matrix, the derivative of temperature corresponding to depth is calculated. The result of this derivative is stored in a new matrix with dimension [m−2×n]. The first and last row of the DTS matrix cannot be applied with the depth derivative. The developing depth derivative matrix is shown in FIG. 10. In the step 135 any viewing software such as MatLab can be used to plot the derivative matrix with time as the horizontal axis and depth as the vertical axis. If color display is operable the color can be coded as a value of temperature derivative. The user can then adjust (step 140) the color scheme of the derivative plot until one or more persistent horizontal boundaries in a production lateral is clearly shown as in FIG. 1B. Horizontal boundaries showing up in the derivative plots are usually persistent through a period of steady state production. Disturbances caused by data instability or simultaneous flow events appear in the plot as noise 150. The user can easily identify boundaries where a completion component eg. an ESP (Electronic Submerged Pump) is installed and those can be eliminated as candidates for production intervals 160. Any discontinuities in the production intervals observed in the derivative plot can then indicate a change of production, such as a rate change, gas ratio change, or a shut-in 170. In the last step 180 quantitative analysis of well production can then proceed based on the production intervals identified.

By default, MatLab uses a Blue-Red color scheme represent the value of the temperature or value of the derivative. In the DTS plot if shown in color, shown in FIG. 1B blue represents a low temperature while red represents a high temperature. Again, as explained before, because color cannot be used in patent applications these are presented as black/white two tone images which still show the new possibilities of data presentation possible by the use of displayed color data. Black represents temperatures lower than 200 Fahrenheit and white represents temperature higher than 200 Fahrenheit.

In DTS the depth derivative (DTS depth gradient), blue represents a temperature decrease along the depth. Red represents a temperature increase along the depth. Large value in red zone indicates a large temperature increase per unit length. Large negative value in blue zone indicates a large temperature drop per unit length. Again because color cannot be used in patent applications these are presented as black and white images which still show the new possibilities of data presentation possible by the use of displayed color data. In black and white black displayed in derivative plot represents a temperature decrease along depth. White represents a temperature increase along the depth.

The resulting depth derivative temperature data as a function of depth and time can be presented in a number of ways. In one example the actual numerical values can be stored for later retrieval and then either displayed on a monitor or printed for study. In another example the resulting depth derivative of temperature can be displayed as different colors on a color display for better understanding and interpretation. In yet another example that same data can be displayed in gray scale.

Fluid Level Identification in the DTS Derivative Plot:

In this example the computation language MatLab is used to apply the following algorithm to each DTS traces to find the boundary between high noise signal (above fluid level)

and low noise signal (under fluid level). By connecting all results from each DTS traces, a boundary profile in time scale can be found in real time and exploited as a measure to identify fluid levels, gas production intervals, water production intervals, and other fluid flow activities inside or near the wellbore during the production process. The dashed line in FIG. 9 represents the results of this automatic calculation. The algorithm reduces the need for expert visual interpretation of the results as it is done automatically.

At each time step, temperature derivative is only a function of depth. A variance can be computed as a function of depth by defining the window in 20 to 30 depths of the data that centered at the calculated depth:

$$T_i' = T'(d_i)$$

$$d_i = d_1, d_3, d_4, d_5, \ldots$$

$$M_i = \frac{T'_{i-10} + T'_{i-9} + T'_{i-8} + \ldots + T'_{i+8} + T'_{i+9} + T'_{i+10}}{21}$$

$$\mathrm{var}_i = \frac{\sqrt{(T_i' - Mi)^2}}{M_i}$$

At each time step $t_j$, a derivative variance as function of depths is computed, a threshold of the variance can be found by trial and error process that its corresponding depth is such a boundary where all variance of the derivative above is larger than the threshold and variance of the derivative below is smaller than the threshold. The same threshold variance can be applied to all derivative traces corresponding to each time step and a depth function with time can be created. This is the fluid level depth function corresponding to time.

$$FL(t_j) = d_i|_{var(d_i) = var_{threshold}}$$

FL is fluid level as function of $t_j$. $d_i$ is depth with index i. var is the derivative variance as function of each depth $d_i$. Var.threshold is the threshold variance at current time stamp $t_j$. The fluid level function with time is created by calibrating with visualization result on depth derivative map to decide a proper threshold variance. The threshold is adjusted until the calculated fluid level as function of time matches with the boundary visualized on a derivative map. The process need only be conducted once and the threshold variance can be applied to all later time steps in real time.

Although certain embodiments and their advantages have been described herein in detail, it should be understood that various changes, substitutions and alterations could be made without departing from the coverage as defined by the appended claims. Moreover, the potential applications of the disclosed techniques is not intended to be limited to the particular embodiments of the processes, machines, manufactures, means, methods and steps described herein. As a person of ordinary skill in the art will readily appreciate from this disclosure, other processes, machines, manufactures, means, methods, or steps, presently existing or later to be developed that perform substantially the same function or achieve substantially the same result as the corresponding embodiments described herein may be utilized. Accordingly, the appended claims are intended to include within their scope such processes, machines, manufactures, means, methods or steps.

The invention claimed is:

1. A method comprising:

a. gathering temperature data from a distributed temperature sensing measurement system through a production region as a function of a depth in a wellbore and as a function of elapsed time;

b. calculating, from the gathered temperature data, depth derivative data of temperature changes as a function of depth in the wellbore and of the elapsed time;

c. displaying the depth derivative data for analysis of fluid levels to identify at least one of fluid levels, gas production intervals, water production intervals, and other fluid flow activities inside or near the wellbore during a production process;

d. gathering acoustic measurement data from a distributed acoustic sensing system as a function of the depth in the wellbore and as a function of the elapsed time; and e. using the acoustic measurement data in conjunction with the depth derivative data to further identify and validate fluid levels, gas production intervals, water production intervals, and other fluid flow activities inside or near the wellbore during the production process.

2. The method of claim 1, wherein numerical values of the depth derivative data are recorded and displayed.

3. The method of claim 1, wherein the depth derivative data is displayed in colors as a function of depth and time.

4. The method of claim 1, wherein the depth derivative data is displayed in black/white as a function of depth and time.

5. The method of claim 1, wherein the depth derivative data is displayed in grey scale as a function of depth and time.

6. The method of claim 1, further comprising:

g. displaying the acoustic measurement data for analysis of fluid levels as a tool of downhole pressure control by operators.

7. A method comprising:

a. providing a fiber optic based distributed temperature sensing measurement system through a production region surrounding a wellbore;

b. gathering temperature data through the production region as a function of a depth in the wellbore and as a function of elapsed time;

c. calculating from the gathered temperature data a depth derivative of temperature changes as a function of depth in the wellbore and of the elapsed time;

d. generating a distributed temperature sensing (DTS) matrix of [m×n] wherein m a number of samples collected in a depth scale and n is a number of samples collected in a time scale;

e. for each column of the DTS matrix calculating a derivative of temperature as a function of depth and storing it in a new matrix with dimensions [m−2×n];

f. displaying the derivative matrix with one axis as time and another axis as depth and color coding a value of the temperature derivative;

g. adjusting a color scheme until one or more persistent horizontal boundaries is found through a production time period with distinct color from adjacent zones; and h. displaying depth derivative data to identify at least one of fluid levels, gas production intervals, water production intervals, and other fluid flow activities inside or near the wellbore during a production process.

8. The method of claim 7, further comprising displaying the depth derivative data in colors as a function of depth and time.

9. The method of claim 7, further comprising displaying the depth derivative data in black/white as a function of depth and time.

10. The method of claim 7, further comprising recording numerical values of the depth derivative data.

11. The method of claim 7, further comprising displaying the depth derivative data in grey scale as a function of depth and time.

12. A method comprising:

a. gathering temperature data through a production region from a distributed temperature sensing measurement system as a function of depth in a wellbore and as a function of elapsed time;

b. calculating from the gathered temperature data depth derivative data of temperature changes as a function of depth in the wellbore and of the elapsed time;

c. displaying the depth derivative data for analysis of fluid levels to identify at least one of fluid levels, gas production intervals, water production intervals, and other fluid flow activities inside or near the wellbore during a production process;

d. calculating a variance of a depth derivative of distributed temperature sensing (DTS) data to find a boundary between high and low noise signals, and thereby generate a boundary fluid level profile in time that can be displayed and used to identify at least one of fluid levels, gas production intervals, water production intervals, and other fluid flow activities inside or near the wellbore during a production process;

e. gathering acoustic measurement data from a distributed acoustic sensing system as a function of the depth in the wellbore and as a function of the elapsed time;

f. displaying the acoustic measurement data; and g. using the acoustic measurement data in conjunction with the depth derivative data to further identify at least one of fluid levels, gas production intervals, water production intervals, and other fluid flow activities inside or near the wellbore during the production process.

* * * * *